United States Patent [19]

Holstedt et al.

[11] 4,427,560

[45] Jan. 24, 1984

[54] ANTI-OXIDATION AND CORROSION INHIBITORS FOR BORON-CONTAINING LUBRICANTS

[75] Inventors: Richard A. Holstedt, Whittier, Calif.; Peter Jessup, Millington, N.J.

[73] Assignee: Union Oil Company of California, Los Angeles, Calif.

[21] Appl. No.: 329,384

[22] Filed: Dec. 10, 1981

[51] Int. Cl.[3] ..... C10M 1/38

[52] U.S. Cl. ..... 252/42.7; 252/46.4; 252/47.5; 252/49.6; 252/49.7; 260/462 R

[58] Field of Search ..... 252/42.7, 46.4, 47.5, 252/49.6, 32.7 E, 49.7; 568/6, 26; 260/462 R, 462 A, 462 C

[56] References Cited

U.S. PATENT DOCUMENTS

| | | | |
|---|---|---|---|
| 2,441,063 | 5/1948 | Gilmann | 260/401 |
| 3,224,971 | 12/1965 | Knowles et al. | 252/46.3 |
| 3,692,681 | 9/1972 | Liston | 252/51.5 A |
| 3,764,534 | 10/1973 | Blejean et al. | 252/42.7 |
| 3,929,652 | 12/1975 | Seni et al. | 252/46.7 |
| 3,977,986 | 8/1976 | Conte, Jr. et al. | 252/47.5 |
| 4,382,006 | 5/1983 | Horodysky | 252/49.6 |

FOREIGN PATENT DOCUMENTS

| | | | |
|---|---|---|---|
| 50-2004503 | 6/1975 | Japan | 252/47.5 |
| 1520743 | 8/1978 | United Kingdom | 252/47.5 |

OTHER PUBLICATIONS

Schrauzer et al., J. Am. Chem. Soc., 88, 4604 (1966).
Chemical Abstract, 95, 45617j (1981).

*Primary Examiner*—Delbert E. Gantz
*Assistant Examiner*—A. Pal
*Attorney, Agent, or Firm*—Dean Sandford; Gregory F. Wirzbicki; Cleveland R. Williams

[57] ABSTRACT

Lubricating compositions containing an oxidation inhibitor, copper and lead corrosion inhibitors and boron and/or metal-boron derivatives having extreme pressure, anti-wear and friction reducing properties are disclosed.

37 Claims, No Drawings

ANTI-OXIDATION AND CORROSION INHIBITORS FOR BORON-CONTAINING LUBRICANTS

BACKGROUND OF THE INVENTION

1. Field of the Invention

This invention relates to lubricating oils, and more particularly to improved lubricating oils containing hydrocarbon derivatives of 2,5-di-mercapto-1,3,4-thiodiazole as copper corrosion inhibitors, terephthalic acid as a lead corrosion inhibitor, bis(dithiobenzil) metal derivatives as oxidation inhibitors, and certain boron and/or metal-boron derivatives having extreme pressure, anti-wear and friction reducing properties.

2. Description of the Prior Art

The use of boron containing compounds as extreme pressure and anti-wear additives for lubricating oils is known and appreciated by the prior art. For example, U.S. Pat. No. 3,313,727 to Peeler discloses compositions of amorphous alkali metal borates as a stable dispersion in lubrication oils. In particular, a boron compound, such as, the metaborates and tetraborates of sodium and potassium in combination with a lyophilic surface active agent, such as the carboxylates, phenates and sulfonates of alkaline earth metals, e.g. calcium and barium, when dispersed in lubricating oil compositions are said to improve the extreme pressure and anti-wear properties thereof.

U.S. Pat. No. 2,987,476 to Hartley et al. relates to a method for solubilizing boric acid and metal borates in liquid fuels for internal combustion engines and in lubricating oils and greases. Desirable compositions are prepared by hydrolyzing an organic ester of boric acid in the presence of three materials, namely, a lyophilic ionic surface active agent, a non-polar organic liquid and a water-miscible organic liquid. The resulting dispersible boron-containing product of this process is a complex of an inorganic boric acid compound with an oleophilic ionic surface active agent.

Another boron composition is dislosed in U.S. Pat. No. 3,598,855 to Cyba which relates to cyclic borates of polymeric alkanolamines formed by reacting a borylating agent with a polymeric alkanolamine. The additives thus formed are described as additives for a wide variety of petroleum products including lubricating oils.

U.S. Pat. No. 3,227,739 to Versteeg relates to lubricating oils containing additives formed by reacting certain amine type compounds with boric acid. The amine type compounds are prepared by reacting equal molar proportions of diethanolamine or dipropanolamine and a long chain 1,2-epoxide.

Another extreme pressure lubrication composition is disclosed in U.S. Pat. No. 3,185,644 to Knowles et al., which relates to lubricating compositions containing amine salts of boron-containing compounds. The amine salts are formed by reaction of a hydroxy substituted amine and a trihydrocarbyl borate. The amine-borate compounds thus formed are described as useful as load carrying additives for mineral and synthetic base lubricating oils.

As can readily be determined from the above, there is an ongoing effort to develop improved lubricating compositions which contain boron and/or boron derivatives.

Accordingly, it is an object of the present invention to provide an improved lubricating composition having enhanced extreme pressure, anti-wear and friction reducing properties.

Another object of the present invention is to provide a lubricating composition having improved copper and lead corrosion properties.

Yet another object of the present invention is to provide a lubricating composition having improved antioxidant properties.

A further object of the present invention is to provide a lubricating composition containing extreme pressure, anti-wear, friction reducing and corrosion prevention additives, plus an anti-oxidant to prevent attack of oxidants upon copper/lead-bearing metal.

These and other objects are accomplished according to the present invention by adding to a lubricating composition a small but effective amount of a boron and/or metal boron additive in combination with copper and lead corrosion prevention additives and anti-oxidant.

SUMMARY OF THE INVENTION

This invention resides in a lubrication composition comprising a major amount of a lubricating oil and a minor amount of:

(A) An extreme pressure, anti-wear, and friction reducing boron compound having the formula:

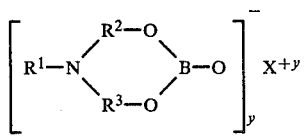

wherein $R^1$ is hydrogen, alkyl, cyclic, alicyclic, aryl, alkylaryl, or arylalkyl radicals having from 1 to about 24 carbon atoms, $R^2$ and $R^3$ are straight or branched carbon chains, alkyl, cyclic, alicyclic, aryl, alkylaryl or arylalkyl-radicals having from 2 to about 20 carbon atoms, Y is a number from 1 to 4, and X is either hydrogen, a transition metal having an atomic number between 21 and 30 or a Group IVA metal of the Periodic Table and mixtures thereof;

(B) A copper corrosion inhibitor comprising a hydrocarbon polysulfide derivative of 2,5-dimercapto-1,3,4-thiadiazole having the formula:

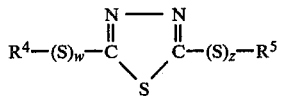

wherein $R^4$ and $R^5$ are moieties selected from hydrogen or straight or branched chain alkyl, cyclic, alicyclic, aryl, alkylaryl or arylalkyl radicals having from 2 to about 30 carbon atoms, provided that $R^4$ and $R^5$ are not both hydrogen and w and z are numbers from 1 to about 8; and (C) A lead corrosion inhibitor comprising terephthalic acid; and (D) A metal derivative of bis(dithiobenzil) having the formula:

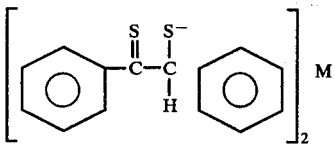

wherein M is a first row transition metal having an oxidation state of +2.

DESCRIPTION OF THE INVENTION

The present invention resides in lubricating oil compositions having extreme pressure, anti-wear, friction reducing, corrosion inhibition and anti-oxidant properties which comprise a major amount of a lubricating oil and a minor amount of a mixture comprising a boron or metal-boron derivative, a hydrocarbon polysulfide derivative of 2,5-dimercapto-1,3,4-thiadiazole, terephthalic acid and a bis (dithiobenzil) metal derivative.

Anti-wear, friction reducing and extreme pressure (or "E.P.") additives, as they are commonly called, are chemicals which are added to lubricating compositions to reduce friction and reduce or prevent destructive metal-to-metal contact by lubricating moving surfaces. Lubricating oils provided good lubrication between moving surfaces in contact with each other, as long as a film of oil is maintained between the relatively moving surfaces. This particular kind of lubrication is commonly termed "hydrodynamic lubrication." However, when pressure and/or rubbing speeds between moving metal surfaces are such that the film of lubricating oil is no longer intact, metal-to-metal contact and wear occur over a significant portion of the previously lubricated area. Under such conditions, a kind of lubrication called boundary lubrication is needed, and is governed by parameters of the contacting surfaces, such as surface finish, hardness, metal shear strength, and the coefficient of friction between the metals involved. Destrutive metal-to-metal contact, due to lack of lubrication under extreme conditions, manifests itself in different forms such as scoring, welding, scuffing, ridging, rippling, rapid wear, and in some cases deformation or complete destruction of the metal components.

Extreme pressure, anti-wear and friction reducing lubricating additives prevent destructive metal-to-metal contact, under boundary lubrication conditions, by adsorption or reaction with relatively moving metal surfaces to form an adherent protective film of compounds which have a lower shear strength than that of the metal surfaces. This film acts in the capacity of a "boundary lubricant" and performs the function of lubrication when metal-to-metal contact occurs. Boundary conditions and boundary lubricant refer to the conditions and a suitable lubricant relating to the combination of applied load, fluid viscosity and rubbing speed, which do not allow hydrodynamic lubrication to exist. Hydrodynamic lubrication exists when a film of lubricant maintains separation between lubricated surfaces.

Many extreme pressure and anti-wear agents are oil soluble or easily dispersed as a stable dispersion in oil. Many of the E.P. agents which provide the high load capacity are chemically reactive, containing chlorine, sulfur or phosphorus which react with metal surfaces.

It has now been discovered that certain oil-soluble or dispersible boron or metal-boron derivatives prepared as described herein, when added to lubricating oils or grease, not only improve the ability of the lubricant to prevent seizure of the parts being lubricated but, in addition, greatly reduce the amount of friction and wear of such moving parts.

The terms "friction reducing and anti-wear" herein refer to the ability of a substance to reduce the coefficient of friction between sliding or rubbing surfaces and/or the ability of a substance to prevent metal-to-metal welding or bonding during rubbing at extremely high contact pressures. "Extreme pressure lubricant" refers to a fluid or other substance which provides lubrication during extreme pressure conditions, including boundary lubrication. The term boramid denotes certain boron-containing compounds, which, as will be further described hereinafter, may be produced by reacting the reaction product of a primary amine, an alkylene oxide or epoxide and boric acid, all of which are further described herein. Metal derivatives of boramids are the the reaction product of the desired metal and specified boramid compound.

The boron and metal-boron derivatives (boramid compounds) herein, however, suffer from the disadvantage of copper and lead corrosion. This problem is solved by adding a small but effective amount of a hydrocarbon polysulfide derivative of 2,5-dimercapto-1,3,4-thiazdiazole as a copper corrosion inhibitor and terephthalic acid as a lead corrosion inhibitor. In addition, the use of bis(dithiobenzil) metal derivatives herein as anti-oxidants, interrupt or terminate the attack of oxidants upon copper/lead-bearing metals.

The extreme pressure anti-wear and anti-corrosion additives, in addition to the corrosion inhibitors and antioxidants described herein may be incorporated in a wide variety of lubricating oils, for example, mineral oil, (including automobile engine oil), crude oil, synthetic oil, and such industrial oils, as cutting oil, metal working fluids and grease. For example, the additives may be added to lubricating oils derived from paraffins, naphthenic or mixed base crude petroleum oils that have been subjected to solvent and/or sulfuric-acid treatment, aluminum chloride treatment, hydrogenation and/or other refining treatments. In addition, the additives described herein may be incorporated in petroleum distillates, such as diesel fuel, jet engine fuel, furnace oil, gas oil and other light oils. The petroleum oils may be of virgin or cracked petroleum stock, or mixtures thereof, boiling in the range of about 100° F. to about 1,100° F. The petroleum oil may contain cracked components such as those derived from cycle oils or cycle cuts boiling above gasoline, usually in the range of about 450° F. to about 750° F. and may be derived by catalytic or thermal cracking. Oils of high or low sulfur content such as diesel fuels or oils may additionally be used including re-refined oils.

Preferred distillate lubrication oils which are improved by the addition of additives herein have an initial boiling point within the range of 350° F. to about 475° F., an end point in the range of about 500° F. to about 1,100° F., and a flash point not lower than 110° F.

Lubricants derived from oil shale are particularly desirable for use herein. Oil shale is generally composed of a variety of compact sedimentary rock, generally laminated, that contains little or no oil but does contain organic material, derived from aquatic organisms or waxy spores and pollen grains, which is convertible to oil by heat. Crude shale oil, in combination with water, gas and spent shale containing a carbonaceous residue and mineral matter, is formed by the pyrolysis of oil shale. The hydrocarbons of shale oil are highly unsaturated, resembling the products of thermal cracking of petroleum, as would be expected because of the pyrolytil origin of shale oil. Once the shale oil is extracted, it may be subjected to conventional hydrotreating procedures to produce a variety of hydrocarbon products, including lubricants.

Synthetic lubricating oils as defined herein are those oils derived from a product of chemical synthesis (man-made oils). Typical examples of such compositions include the polyglycol fluids (i.e., polyalkylene glycol); silicones which consist of a silicone-oxygen polymer chain to which are attached hydrocarbon branches composed of either alkyl or phenyl groups; phosphates; polyphenyl esters; synthetic hydrocarbons and various esters of organic acids and alcohols. Others include lubricating oils derived from solid carbonaceous products, such as coal, and the like.

The polyalkylene glycol lubricating oils suitable for use herein preferably are derived from the reaction product of the appropriate alkylene oxides. The alkylene moiety of the above compositions have a carbon chain of from 7 carbon atoms and a molecular weight within the range of from about 200 to about 2,000, especially from about 200 to about 1,000, most preferably from about 200 to about 800. Representative examples of suitable polyalkylene glycols include, polyethylene glycol, polypropylene glycol, polyisopropylene glycol, polybutylene glycol and the like.

Silicone lubricants have extra-ordinary low viscosity-temperature coefficients coupled with good oxidation stability. The lubricant contains a repeating silicon-oxygen backbone and has organic groups R, wherein R is methyl, phenyl, vinyl and the like. The silicones herein have an average molecular weight within the range of from about 400 to about 9,000.

The polyphenyl ethers suitable for use herein have from 3 to 7 benzene rings and from 1 to 6 oxygen atoms, with the stated oxygen atoms joining the stated benzene rings in chains as ether linkages. One or more of the stated benzene rings in these polyphenyl ethers may be hydrocarbonyl-substituted. The hydrocarbonyl substituents, for thermal stability, must be free of CH and aliphatic CH so that preferred aliphatic substituents are lower saturated hydrocarbon radicals (1 to 6 carbon atoms like methyl and tertbutyl, and preferred aromatic substituents are aryl radicals like phenyl and tolyl. In the latter case, the benzene ring supplied in the hydrocarbonyl substituent contributes to the total number of benzene rings in the molecule. Polyphenyl ethers consisting exclusively of chains of from 3 to 7 benzene rings with at least one oxygen atom joining the stated benzene rings in the chains as an ether linkage have particularly desirable thermal stability.

Exemplary of the alkyl polyphenyl ethers suitable for use are 3-ring polyphenyl ethers like 1-(p-methylphenoxy)4-phenoxybenzene and 2,4-diphenoxy-1-methyl-benzene, 4-ring polyethers like bis [p-(p-methylphenoxy)phenyl] ether and bis [(p-tert-butylphenoxy)-phenyl] ether, and the like.

Polyphenyl ethers consisting exclusively of benzene rings and ether oxygen atoms linking said rings are exemplified by the triphenoxy benzenes and aryl-substituted polyphenyl ethers such as biphenyl phenoxyphenyl ether, biphenylyloxyphenyl phenoxyphenyl ether, biphenylyl ether, dibiphenylyloxybenzene, bis(-phenylyloxyphenyl) ether, and the like.

A preferred class of polyphenyl ethers comprises those consisting of benzene rings joined in a chain by oxygen atoms as ether linkages between each ring. Examples of the polyphenyl ethers contemplated in the class are the bis(phenoxy-phenyl)ethers (4 benzene rings joined in a chain by 3 oxygen atoms), illustrative of which is bis(m-phenoxyphenyl) ether. The bis(phenoxy-phenoxy) benzenes are particularly preferred in the present invention. Illustrative of these are m-bis(m-phenoxy-phenoxy) benzene, m-bis(p-phenoxy-phenoxy) benzene, o-bis(o-phenoxy-phenoxy) benzene, and so forth. Further, the polyphenyl ethers suitable for use herein include the bis(phenoxy-phenoxy-phenyl) ethers such as bis[m-(m-phenoxy-phenoxy) phenyl] ether, bis[p-(p-phenoxy-phenoxy phenyl] ether, m-(m-phenoxy-phenoxy)phenyl m-(o-phenoxy-phenoxy) phenyl ether and the bis (phenoxy-phenoxy-phenoxy) benzenes such as m-bis(m-phenoxy-phenoxy-phenoxy) benzene, p-bis[p-(m-phenoxy-phenoxy)phenoxy] benzene and m-bis[m-(p-phenoxy-phenoxy)phenoxy] benzene.

Synthetic lubricating oils derived from hydrocarbons are generally of two types, namely, dialkylated benzene, polymerized alpha-olefins and/or hydrogenated polymerized alpha-olefins. Dialkylated benzene herein is formed from the condensation product of the appropriate alkyl compound and has a carbon chain from about 5 to about 50 carbon atoms, preferably from about 8 to about 20 carbon atoms, and a molecular weight of from about 200 to about 1,500, preferably from about 300 to about 700. Representative compounds include di-n-decylbenzene, n-decyl-n-tetradecylbenzene, and n-nonyl-n-dodecylbenzene.

Alpha-olefins suitable for use in preparing lubricating oils herein are characterized by the formula $RCH{=}CH_2$, wherein R is a radical selected from the group of hydrogen and alkyl radicals having from about 4 to about 18 carbon atoms, preferably from about 6 to about 10 carbon atoms, and having a molecular weight of from about 80 to about 300, preferably from about 100 to about 200. Typical compounds include 1-octene, 1-decene and 1-dodecene.

Phosphates suitable for use herein as synthetic lubricating oils are the phsophate esters having the formula $O{=}P(OR)_3$, wherein R is aryl or alkyl having from about 4 to about 20 carbon atoms, preferably from 6 to about 10 carbon atoms, and have a molecular weight within the range of from about 200 to about 1,000, preferably from about 300 to about 550. Representative compounds include trioctyl phosphate, tricresyl phosphate and dicresyl methyl phosphate.

Esters of organic acids which are suitable for use herein as synthetic lubricating oils preferably are selected from organic acids having carbon chains of from $C_4$ to $C_{40}$ carbon units. Organic acids which may be reacted with the alcohols herein include caproic, decanoic, sebacic, laurel, oleic, stearic, palmitic etc. Likewise, alcohols herein may be derived from either natural or synthetic origin for example, pentarythritol, trimethylolpropane, amyl, 2-ethylhexanol or laural alcohol, etc., may be used to form the desired ester. The esters are formed using conventional methods. For example, the esters may be prepared by reaction of the desired alcohol with the desired acid, acid anhydride or acid halide using conventional reaction conditions and techniques.

Synthetic lubricating oils which are improved by the addition of the additives herein additionally include those derived from solid carbonaceous products, conveniently prepared by blending finely ground carbonaceous materials with a solvent to form a slurry. The slurry is then introduced into a reaction vessel containing a conventional hydrogenation catalyst and is reacted under normal hydrogenating pressures and temperatures. After hydrogenation, solids that are present may conveniently be removed from the product stream. The product is next stripped of solvent. The balance of the product stream may be distilled to obtain products of various boiling ranges, for example, hydrocarbons boiling in the gasoline range and hydrocarbons boiling in the lubricating oil range. Some of the products are useful as fuels and oils, the remainder may be further treated by a conventional petroleum process including cracking, hydrocracking, and the like. Synthetic lubricating oils produced from solid carbonaceous products, such as coal, are primarily aromatic and generally having a boiling range of about 300° F. to about 1,400° F., a density of about 0.7 to about 1.1 and a carbon to hydrogen molecular ratio in the range of about 1.3:1 to about 0.66:1. A typical example is a lubricating oil obtained from a subbituminous coal, such as Wyoming-Montana coal, comprising a middle oil having a boiling range of from about 375° F. to about 675° F. A description of how to prepare synthetic lubricating oils from a carbonaceous material, for example coal, is set forth in greater detail in U.S. Pat. No. 3,957,619 issued to Chun et al. on May 18, 1976, the disclosure of which is incorporated herein by reference.

Alternatively, the synthetic oil improved herein may be a nonhydrocarbon oil of lubricating viscosity. Suitable examples include synthetic oils obtained by polymerization of lower molecular weight alkylene oxides, such as propylene oxide and/or ethylene oxide employing alcohol or acid initiators, such as lauryl alcohol or acetic acid. Other typical synthetic oils include esters, for example, di(2-ethylhexyl)-silicate, tricresylphosphate and silicate esters, such as tetra-(2-ethyl-hexyl)-orthosilicate and hexa-(2-ethylbutoxy)-disiloxane.

If desired, the extreme pressure, anti-wear and friction reducing additives described herein may be employed in conjuction with other additives commonly used in petroleum products. Thus, there may be added to the oil compositions of this invention other rust and corrosion inhibitors, emulsifying agents, antioxidants, dyes, haze inhibitors, anti-static agents, detergents, dispersants, viscosity index improvement agents, extreme pressure, anti-wear, friction reducing and pour point reducing agents in addition to the additives used herein. Soaps or other thickening agents may be added to the lubricating oil compositions to form compositions having the consistency of a grease. When other additives are employed, it may be desirable, although not necessary, to prepare additive concentrates comprising concentrated solutions of the herein boron or metal-boron derivatives together with said other additives whereby the several additives are added simultaneously. Dissolution of the additive or additive concentrate into the oil composition may be facilitated by mixing accompanied with mild heating, but this is not absolutely essential.

Metal-working fluids such as cutting and grinding fluids are defined as liquids applied to a cutting tool or apparatus to assist in a cutting or machining process by washing away chips or serving as a lubricant or coolant, for example, in milling, drilling, turning, cutting, threading, broaching, surface grinding, form grinding, flute grinding, and similar metal-working operations. These oils are preferably obtained from conventionally refined lubricating oils containing film-strength additives or sulfurized naphthene-base oils, which may additionally contain emulsifying agents. Representative fluids and agents include: water, water solutions or emulsions of detergents and oils, mineral oils, fatty oils, chlorinated mineral oils, sulfurized mineral oils and mixtures thereof.

The herein described extreme pressure, anti-wear friction reducing and anit-corrosion additives may be incorporated in the lubricating oils in any convenient way. Thus, the above-described additives may be added directly to the lubricating oil by dissolving the desired additive(s) in said oil at the desired level of concentration.

Normally, the additive comprising boron or metal-boron derivatives is blended with the lubricating oil from about 0.1 to about 15 percent by weight, preferably from about 0.5 to about 10 percent by weight of the oil composition. Alternatively, the additive(s) may be blended with suitable solvents to form concentrates that may readily be dissolved in the appropriate oil at the desired concentration. If a concentrate is employed, it ordinarily will contain at least 10 to about 80 percent by weight of the additive(s) and preferably from 25 to about 75 percent by weight of said additive(s). The solvent in such a concentrate may be present in amounts of about 35 to about 75 percent by weight. Suitable solvents which may be used for this purpose are naphtha, and light mineral oil (i.e., 150 neutral to 450 neutral) and mixtures thereof. The particular solvent selected should, of course, be selected so as not to adversely affect the other desired properties of the ultimate oil composition. Thus, the solvent for use in incorporating the additive in an oil or fuel oil should be compatible with the oil or fuel oil in terms of stability, boiling range, corrosiveness, etc.

The extreme pressure, anti-wear and friction reducing boron compounds of the present invention are represented by the following formula:

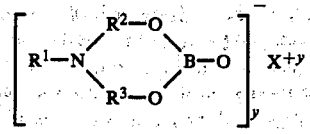

wherein $R^1$ is hydrogen, alkyl, cyclic, alicyclic, aryl, alkylaryl, or arylalkyl radicals having from 1 to about 24 carbon atoms, preferably from 1 to about 18 carbon atoms, $R^2$ and $R^3$ are the same or different, straight or branched carbon chains, alkyl, cyclic, alicyclic, aryl, alkyaryl, or arylalkyl radicals having from 2 to about 20 carbon atoms, especially from about 2 to about 10 carbon atoms, y is a number from 1 to 4, and X is either hydrogen or a metal selected from transition metals having an atomic number between 21 and 30 or a Group IVA metal of the Periodic Table and mixtures thereof.

The above group of compounds, including metal derivatives thereof are referred to herein as boramids. The above compounds are conveniently prepared by reacting a primary amine with an alkylene oxide or epoxide. The resulting product is then reacted with boric acid to give the corresponding boramid compound. Amines which are suitable for use herein include methylamine, ethylamine, propylamine, butylamine, octadecylamine, dodecylamine, cyclohexylamine, phenylamine, cocoamine, tallowamine and oleylamine and mixtures thereof. A wide variety of alkene oxides or epoxides may be used to prepare the precursor for the boramid compounds herein. Typical alkene oxides or epoxides which are suitable for use include ethylene oxide, propylene oxide, 1,2-epoxybutane, cyclohexene oxide, cyclooctene oxide, cyclododecene oxide, styrene oxide, and 1,2-epoxybenzene and mixtures thereof. Normally, the boron atom will comprise from about 0.5 to about 10 weight percent, especially from about 2 to about 5 weight percent of the boramid compound. The boramid and/or metal-boramid compounds produced in accordance with the procedure herein are preferably selected from the group consisting of methylaminodiethylate hydrogen borate, ethylaminodiethylate hydrogen borate, propylaminodiethylate hydrogen borate, butylaminodiethylate hydrogen borate, octadecylaminodiethylate hydrogen borate, dodecylaminodiethylate hydrogen borate, cyclohexylaminodiethylate hydrogen borate, phenylaminodiethylate hydrogen borate, oleylaminodiethylate hydrogen borate, cocoaminodiethylate hydrogen borate, tallowaminodiethylate hydrogen borate, and dodecylamino di(phenyl ethylate) hydrogen borate and mixtures thereof.

It should be noted that a transition metal having an atomic number between 21 and 30 or a Group IVA metal of the Periodic Table may be incorporated into the boramid compounds herein. When a transition metal or Group IVA metal is incorporated into said compound, the metal component will replace the hydrogen atom on the hydroxy portion of the structure. In addition, the Examples, as set forth hereinafter, recite cocoaminodiethylate hydrogen borate as boramid C/12, tallowaminodiethylate hydrogen borate as boramid T/12 octadecylaminodiethylate hydrogen borate as boramid 18/12, and dodecylamino di(phenyl ethylate) hydrogen borate as H-boramid-CDS. The corresponding metal-boron derivatives will, of course, incorporate the desired metal into the composition before the boramid nomenclature, for example, zinc boramid C/12, etc.

Metals are conveniently incorporated into the boramid compound using conventional methods and apparatus. Normally, the metal is reacted with the desired boramid compound in salt form. Thus the metal acetates, propanates, hexanates etc. are suitable for use. It should be noted that not all metal salts are desirable for incorporating the metal ion into the boramid compound. The metal carbonates, nitrates, oxalates, chlorides, sulfates, hydroxides and oxides, to name a few, are all undesirable as vehicles for imparting metal ions into the boramid compound. These metal salts present solubility problems, separation problems and in addition, undesirable ions are frequently left in the boramid compound.

Desirable metals are conveniently selected from first row transition metals of the Periodic Table. Transition metals which are suitable for use are selected from scandium titanium, vanadium, chromium, manganese, iron, cobalt, nickel, copper, zinc and mixtures thereof. Group IVA metals which are useful herein include tin and lead mixtures thereof. Normally, the metal will comprise from about 1 to about 17 weight percent, preferably from about 5 to about 10 weight percent of the boramid compound.

Generally, when two different boramid compounds or derivatives thereof are blended together, a weight ratio of from about 1:20 to about 20:1, preferably from about 1:10 to about 10:1 is highly desirable for imparting extreme pressure, anti-wear and friction reducing properties to a lubricant.

Use of copper and lead in the construction of improved internal combustion engines has created problems in the use of boramid extreme pressure additives in lubricants for such engines. The primary problem being the leaching out of copper and lead from bearings used in said engines.

Copper corrosion in engine bearings is inhibited by adding to the lubrication composition a corrosion inhibiting amount, preferably from about 0.001 to about 5 weight percent, especially from about 0.005 to about 2.5 weight percent of a hydrocarbon polysulfide derivative of 2,5-dimercapto-1,3,4-thiadiazole having the formula:

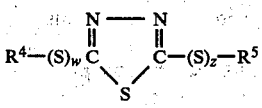

wherein $R^4$ and $R^5$ are the same or different moieties selected from hydrogen or straight or branched chain alkyl, cyclic, alicyclic, aryl, alkylaryl or arylalkyl radicals having from 2 to about 30 carbon atoms, and W and z are numbers from 1 to about 8. It should be noted that $R^4$ and $R^5$ cannot be hydrogen at the same time because the compound would be rendered insoluble in lubricating oils. Thus, when $R^4$ is hydrogen, $R^5$ must be selected from one of the other moieties described above.

The herein-described polysulfide derivatives of 2,5-dimercapto-1,3,4-thiadiazole can be suitable prepared by several methods. For example, they can be prepared by reacting 2,5-dimercapto-1,3,4-thiadiazole with a suitable sulfenyl chloride, or by reacting the dimercaptan with chlorine and reacting the resultant disulfenyl chloride below,

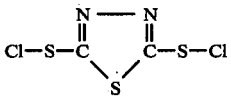

with a primary or tertiary mercaptan. Bis-trisulfide derivatives are obtained by reacting the dimercaptan with a mercaptan and a sulfur chloride in molar ratios of from 1:2:2 to 1:2:4 at a temperature of from about 120° to 212° F. Higher polysulfides may be prepared by reacting the thiadiazole dior trisulfides with sulfur at temperatures of about 200° F. to 400° F. Another method of preparing the polysulfides of the present invention involves reacting 2,5-dimercapto-1,3,4-thiadiazole with a mercaptan and sulfur in the molar ratio of from 1:1:1 to 1:4:16 at temperatures of from about 160° F. to about 300° F. The 2-mercapto, 5 alkyldithio-1,3,4-thiadiazole derivative may be prepared by reacting less than the stoichrometric amount of a primary or tertiary mercaptan with the disulfenyl chloride above to produce the bis form of the compound.

Compounds produced in accordance with the above procedure preferably are polysulfides of 1,3,4-thiadiazole-2,5-bis(alkyl, di-tri or tetra sulfide) containing from 2 to about 30 carbon atoms. Desirable polysulfides include 1,3,4-thiadiazole-2,5-bis (octyldisulfide); 1,3,4-thiadiazole-2,5 -bis(octytrisulfide); 1,3,4-thiadiazole-2,5-bis (octyltetrasulfide); 1,3,4-thiadiazole- 2,5 -bis (dodecyldisulfide); 1,3,4-thiadiazole-2,5 bis (dodecyltrisulfide); 1,3,4-thiadizole-2,5 bis (dodecyltetrasulfide); 2-lauryldithia-5-thiaalpha-methylstyryl-1,3,4 thiadiazole; 2-lauryltrithia-5-thiaalphamethylstyryl-1,3,4 thiadiazole; 2-mercapto-5-octyldithio-1,3,4-thiadiazole and 2-mercapto-5-dodecyldithio-1,3,4-thiadiazole and mixtures thereof.

An especially desirable ratio of the above copper corrosion inhibitors, when two are mixed together is from 1:20 to 20:1, preferably from 1:10 to 10:1.

A small but effective amount of terephthalic acid is the preferred lead corrosion inhibitor herein. The terephthalic acid may be prepared in accordance with conventional techniques and apparatus. For example, para-xylene may be oxidized to terephthalic acid at increased temperature and pressure in the presence of acetic acid, a bormine promoter and a heavy metal catalyst, i.e., cobalt, manganese, etc. A second method of preparing terephthalic acid comprises reacting benzene and potassium carbonate over a cadmium catalyst at increased temperature and pressure. Generally, the terephthalic acid is incorporated into lubricating oils at a concentration of from about 0.001 to about 1 weight percent, especially from about 0.01 to about 0.05 weight percent.

The oxidation inhibitors or anti-oxidants herein have high enough molecular weights to ensure that they remain stable in a hot crankcase oil, e.g. 300° F. and, in addition, enhance the corrosion preventive properties of the copper and lead corrosion inhibitors by interrupting or terminating the attack of oxidants upon copper/-lead-bearing metal. One type of corrosion is an oxidative process involving the loss of electrons from the corroding metal by an oxidant such as oxygen, air, nitrogen oxides, partially burned gasoline, blow-by products and the like. The oxidation inhibitors as described hereinafter, comprising sulfur bridged, bis hindered phenols effectively limit or prevent the attack of oxidants on copper/lead metal.

The bis(dithiobenzil) metal derivatives herein preferably have the formula:

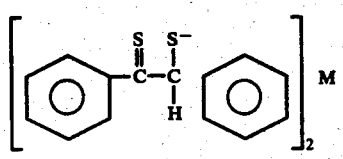

wherein M is a first row transition metal having an oxidation state of +2. Suitable transition metals include vanadium, chromium, manganese, iron, cobalt, nickel, copper, zinc, preferably iron, cobalt and nickel.

Generally, the bis(dithiobenzil) metal derivatives are prepared in accordance with conventional techniques and procedures. For example benzoin is reacted with phosphorus sulfide in the presence of dioxane at increased temperature to produce the thiophosphoric ester of dithiobenzoin. The desired divalent metal, for example, metallic halide, is reacted with the above-described thiphosphoric ester of dithiobenzoin to produce the bis(dithiobenzil) metal derivative.

It should be noted that the bis(dithiobenzil) metal derivatives herein do not readily dissolve in lubricant compositions. However, when the bis(dithiobenzil) metal derivatives are mixed with the boramid compounds herein, especially dodecylamino di(phenylethylate) hydrogen borate, the mixture goes into solution in lubricant compositions such as motor oils. Although the invention is not bound by any theory, it is believed that the boramid compound and bis(dithiobenzil) metal derivative form a complex which renders the bis(dithiobenzil) metal derivative soluble in lubricants, for example, motor oil.

Normally, the bis(dithiobenzil) metal derivatives are incorporated into the lubricant composition in concentrations from about 0.01 to about 1 weight percent, especially from about 0.025 to about 0.10 weight percent. Bis(dithiobenzil) metal derivatives which are suitable for use as anit-oxidants include bis (dithiobenzil) iron, bis(dithiobenzil) cobalt, bis(dithiobenzil) nickel, bis(dithiobenzil) copper, bis(dithiobenzil) zinc, bis (dithiobenzil) vanadium, bis(dithiobenzil chromium, and bis (dithiobenzil) manganese and mixtures thereof.

The invention will now be described with reference to several non-limiting examples. In Examples I to X, there is described the preparation of certain preferred boramid compounds which are useful as extreme pressure, anti-wear and friction-reducing additives in the lubricating compositions herein. A method of preparing preferred copper corrosion inhibitors is disclosed in Examples XI and XII. Examples XIII and XIV exemplify a preferred method for preparing oxidation inhibitors suitable for use herein. The lead corrosion inhibitor useful in the invention (terephthalic acid) may be prepared in accordance with conventional techniques and therefore is not exemplified. The superiority of the foregoing compounds, when added in combination to a lubricating oil in accordance with the invention, is established by the comparison of Examples XVI to XX.

The invention will be further described with reference to the following non-limiting Examples.

EXAMPLE I

A boramid compound is prepared by adding 20 grams of boric acid, 95 grams of Armak Ethomeen C/12 [bis(2-hydroxyethyl) cocoamine] and 250 ml of toluene to a single-necked one liter round-bottom flask. The toluene acts as a solvent and as an azeotrope for water produced during the reaction. It should be noted that boric acid is not soluble in toluene or Ethomeen C/12. The flask is placed in a heating mantle and fitted with a Dean-Stark trap that is topped with a condenser. The mixture thus formed is, then, heated until it begins to reflux. Next, the mantle is adjusted to give a moderate reflux rate. The reaction mixture is refluxed for one hour, or until the stoichiometric amount of water (12 ml) collects in the Dean-Stark trap and all of the boric acid has dissolved, after which the toluene is distilled from the reaction product. The reaction product (103 grams) is designated boramid C/12 and has a clear golden color. Boramid C/12 is a fluid liquid while hot but sets into a soft viscous material when cooled to room temperature. The compound is readily soluble in hydrocarbon solvents and water.

EXAMPLE II

A boramid compound is prepared by following the procedure of Example I with the following substitution:

Armak Ethomeen T/12 [bis(2-hydroxyethyl) tallowamine] is substituted for the Armak Ethomeen C/12. Substantially the same results are obtained, however, the resulting compound is designated boramid T/12.

EXAMPLE III

A boramid compound is prepared by mixing 20 grams of boric acid, 95 grams of Armak Ethomeen 18/12 [bis (2-hydroxyethyl) octadecylamine] and, as a solvent, 250 ml of toluene in a single-necked one liter round-bottomed flask. The flask is placed in a heating mantle and fitted with a Dean-Stark trap and water cooled condenser. The mixture is heated under reflux for one hour, during which 12 ml of water collects in the Dean-Stark trap. The toluene is then distilled from the reaction product. The compound is designated boramid 18/12 and is readily soluble in hydrocarbon solvents and water.

EXAMPLE IV

The procedure of Example III is followed to prepare a boramid compound with the following exception: N,N-diethanol-n-methylamine (46.3 grams) is substituted for the Armak Ethomeen 18/12. The reaction product thus produced is a liquid product with the consistency of honey when hot and becomes a waxy semi-solid when cooled to room temperature.

EXAMPLE V

Boric acid (20 grams), N,N-diethanol-N-phenylamine (46.3 grams) and 250 mls of toluene are mixed in a one liter single-necked flask to prepare a boramid compound. The flask is equipped with a heating mantle, Dean-Stark trap and water-cooled condenser. The mixture is heated under reflux until the reaction is completed (12 ml of water collects), approximately one hour, and the toluene is distilled from the reaction mixture. The product thus prepared is suitable for use as an extreme pressure, antiwear and friction reducing additive for lubrication compositions.

EXAMPLE VI

A metal derivative of boramid C/12 is prepared by mixing 54 grams of the product of Example I (boramid C/12), 400 ml of toluene, 24.6 grams of nickel acetate and 150 ml of methanol in a single-necked, one liter round bottom flask which is equipped with a heating mantle and water-cooled condenser. The mixture is refluxed for four hours. Next, water, toluene, methanol and acetic acid are distilled from the reaction product. The product (59 grams) contained 7.8 weight percent nickel as determined by emission spectroscopy and the resulting product is a fluid green liquid when hot, which turns into a solid upon cooling to room temperature. The product is readily soluble in hydrocarbon solvents and water.

EXAMPLE VII

A metal boramid is prepared by following the procedure of Example II with the following exception: the boramid T/12 (54 grams), 400 ml of toluene, 24 grams of nickel acetate and 150 mls of methanol are mixed in a single-necked, one liter round bottom flask, equipped with a heating mantle, Dean-Stark trap and water-cooled condenser. The mixture is refluxed for four hours and the toluene, water and acetic acid are distilled from the reaction product.

EXAMPLE VIII

A zinc derivative of boramid C/12 is prepared by mixing 54 grams of the reaction product of Example 1 (boramid C/12) with 400 ml of toluene, 19.1 grams of zinc acetate and 50 ml of methanol in a single-necked, one liter round bottom flask, equipped with a heating mantle and water-cooled condenser. The mixture is refluxed for four hours and the toluene, methanol, water and acetic acid are distilled. The resulting product is suitable for use as an extreme pressure, anti-wear, friction reducing additive for lubricating compositions.

EXAMPLE IX

A metal boramid is prepared by following the procedure of Example VII with the following exception: zinc acetate is substituted for the nickel acetate to produce zinc-boramid T/12.

It is to be noted that transition metals having an atomic number between 21 and 30, and Group IVA metals of the Periodic Table may be substituted for the nickel and zinc metals herein to prepare corresponding metal bromids.

EXAMPLE X

Dodecylamino di(phenylethylate) hydrogen borate is prepared by adding 34.85 pounds of dodecylamine (1 equivalent) and 41.0 pounds of styrene oxide (2 equivalents) to a 17 gallon round bottomed flask equipped with a water cooled condenser and containing 3 gallons of toluene and 1 liter of water. The reaction is exothermic and begins immediately upon addition of the above reactants. Additional heat is applied and the reaction mixture is refluxed for a total of 24 hours, however, as little as 2 hours may result in complete reaction. The reaction is cooled to room temperature, 10.49 pounds of boric acid (1 equivalent) is added and the flask is equipped with a Dean-Stark trap. Heat is again applied and the reaction mixture refluxed until water stops collecting in the trap. Toluene is, then, distilled from the reaction product at a temperature of 400° F. or less. About 6 liters of water collect in the Dean-Stark trap. The reaction produces approximately 75 pounds of product and is designated as H-boramid-HDS.

EXAMPLE XI

A copper corrosion inhibitor comprising 1,3,4-thiodiazole-2,5-bis(dodecyldisulfide) is prepared by chlorinating 284 grams of n-dodecyl mercaptan in 0.6 liter of carbon tetrachloride with 1.47 moles of chlorine over a two hour period at a temperature of about 23° F. to about 32° F. Next, sulfenyl chloride which forms as a reaction product is stripped with nitrogen to remove hydrogen chloride, and the resultant compound is added to 86 grams of a 2,5-dimercapto-1,3,4-thiadiazole slurry. The mixture is heated at 86° F. for 1½ hours and the resultant compound (1,3,4-thiadiazole-2,5-bis (dodecyldisulfide) is recovered by washing with water and sodium bicarbonate and vacuum stripping to remove carbon tetrachloride.

EXAMPLE XII

The procedure of Example XI is followed to prepare 1,3,4-thiodiazole-2,5-bis (octyldisulfide) with the following exception: octyl mercaptan is substituted for the dodecylmercaptan.

EXAMPLE XIII

The oxidation inhibitor, bis(dithiobenzil) iron (II) is prepared by adding 400 grams of benzoin and 600 grams of phosphorus sulfide to a single-necked 5 liter, round bottom flask equipped with heating mantle and water-cooled condenser and containing 1,500 ml of dioxane.

The mixture thus formed is refluxed for two hours. Next, 200 grams of hydrated ferrous chloride dissolved in 500 ml of water is added to the 5 liter flask and the mixture is heated on a steam bath (212° F.) for 2 hours. The reaction product thus formed (169.5 grams) is filtered and washed with methanol.

EXAMPLE XIV

The oxidation inhibitor, bis(dithiobenzil) nickel is prepared by adding a mixture of 100 grams of benzoin, 150 grams of phosphorus sulfide and 700 ml of dioxane to a 5 liter, single necked flask equipped with heating mantle and water cooled condenser. The above-described mixture is, then, refluxed for 2 hours, during which the thiophosphoric ester of dithiobenzoin is formed and hydrogen sulfide is evolved. The reaction mixture is cooled and a solution of 50 grams of nickel chloride (hydrated) in 200 ml of water is added to the flask and heated (212° F.) for 2 hours on a steam bath. Black crystals of bis(dithiobenzil) nickel are formed and collected by filtering the cooled solution. Purification is effected by extraction with boiling toluene.

It should be noted that other bis(dithiobenzil) metal derivatives may be prepared in accordance with the above procedure by substituting the metals herein for the nickel described above.

EXAMPLE XV

The extreme pressure, anti-wear and friction reducing additives boramid C/12 produced in Example I and boramid T/12 produced in Example II are sequentially mixed with SAE 10 W/40 motor oil[a] containing 0.15 weight percent of phosphorous and 0.17 weight percent of calcium.

The additive and/or lubricant composition is tested in accordance with the procedure disclosed in ASTM D3233-73 (Reapproved 1978) using a Falex lubricant tester. The test, in accordance with the above ASTM designation, is performed by applying resistance to a revolving metal journal. A rachet mechanism movably attached to two V-Blocks applies resistance by steadily increasing pressure on the journal. The metal journal and V-Blocks (steel) are submerged in the lubricant composition to be tested. The results are indicated in Table 1 below.

TABLE 1

| | Torque on Journal (lbs.-in.) | | |
|---|---|---|---|
| True Load lbs | SAE 10W/40[a] Without Additive | SAE 10W/40 With 1 wt. % Boramid C-12 | SAE 10W/40 With 1 wt. % Boramid T-12 |
| 100 | 8 | 7½ | 7½ |
| 250 | 12 | 10 | 9 |
| 500 | 19 | 15 | 14 |
| 750 | 22 | 18 | 19 |
| 1,000 | 25 | 22 | 22 |
| 1,250 | 35 | 25 | 25 |
| 1,500 | Journal | 27 | 27 |

TABLE 1-continued

| | Torque on Journal (lbs.-in.) | | |
|---|---|---|---|
| True Load lbs | SAE 10W/40[a] Without Additive | SAE 10W/40 With 1 wt. % Boramid C-12 | SAE 10W/40 With 1 wt. % Boramid T-12 |
| | Shear | | |
| 1,750 | — | Journal Shear | 33 |
| 2,250 | — | — | Journal Shear |

[a]Union Super Motor Oil, marketed commercially by the Union Oil Company of California.

It should be noted that the other boramid compounds herein, including the metal derivatives thereof, may be substituted for the boramid C/12 and boramid T/12 compounds above with substantially the same results.

EXAMPLES XVI TO XX

A lubricant composition containing H-boramid-CDS, 1,3,4-thiadiozole-2,5-bis(octyldisulfide) and terephthalic acid is tested for copper and lead corrosion inhibition properties and, in addition containing bis(dithiobenzil) iron as an anti-oxidant, using a single-cylinder Labeco CLR Test Engine equipped with sintered copper (65 wt.%)/lead (35 wt.%) connecting rod bearings, in accordance with the procedure of Federal Test Method Standard No. 791B, Method 3405.2. The lubricant composition used is a standard SAE 30 motor oil containing the additives and concentrations disclosed in Table 3.

The copper lead corrosion tests are conducted in accordance with the test conditions of Table 2 below:

TABLE 2

| Operating Conditions | |
|---|---|
| Test Duration, Hours | 40 |
| Speed, RPM | 3150 ± 25 |
| Load, BHP | 6.5a |
| Fuel Flow, Lb/Hr. | 4.75 ± 0.25 |
| Air/Fuel Ratio | 14.0 ± 0.5 |
| Jacket Outlet Coolant Temp., °F. | 200 ± 2 |
| Gallery Oil Temp., °F. | 290 ± 2 |
| Spark Advance, BTDC | 35 ± 1 |
| Oil Pressure, PSI | 40 ± 2 |
| Crankcase Vacuum, in. $H_2O$ | 2 ± 0.5 |
| Exhaust Back Pressure, in. Hg. | 0.5 ± 0.5 |
| Crankcase Off-Gas, CFH | 30 ± 1 |
| Oil Charge, Pints | 3.5 |

The test is conducted by charging 3.5 pints of the test lubricant to the engine sump. Test duration consists of 40 hours operation at the prescribed test conditions of Table 2 above. When the prescribed gallery oil temperature is reached, the test time begins. Interim oil adjustments are made at the end of 10, 20 and 30 hours of test operation. A copper/lead bearing weight loss of about 40 mg or lower is considered acceptable. All of the tests are conducted using SAE 30 motor oil containing the additives and/or compounds, including concentrations in Table 3 below.

TABLE 3

| Example | H—Boramid—CDS[A] (Wt. %) | Copper Corrosion Inhibitor[B] (Wt. %) | Terephthalic Acid (Wt. %) | Anti-Oxidant[C] (Wt. %) | Phosphorous (Wt. %) | Amoco[D] PCO-059 | CRC L-30 Engine Test 40 hours (BWL, mg)[E] |
|---|---|---|---|---|---|---|---|
| XVI | 2.12 | — | — | — | 0.05 | 6.5 | 93 |
| XVII | 2.12 | 0.050 | 0.05 | — | 0.05 | 6.5 | 43.0 |
| XVIII | 2.12 | 0.075 | 0.05 | — | 0.05 | 6.5 | 40.0 |
| XIX | 2.00 | 0.03 | 0.03 | — | 0.05 | 6.5 | 38 |

TABLE 3-continued

| Example | H—Boramid—CDS[A] (Wt. %) | Copper Corrosion Inhibitor[B] (Wt. %) | Terephthalic Acid (Wt. %) | Anti-Oxidant[C] (Wt. %) | Phosphorous (Wt. %) | Amoco[D] PCO-059 | CRC L-30 Engine Test 40 hours (BWL, mg)[E] |
|---|---|---|---|---|---|---|---|
| XX | 2.00 | 0.075 | 0.05 | 0.05 | 0.05 | 6.5 | 34.8 |

[A]H—Boramid CDS = dodecylamino di(phenylethylate) hydrogen borate.
[B]Copper Corrosion Inhibitor = A mixture of 83 weight percent 1,3,4-thiodiazole-2,5-bis(octyldisulfide) and 17 weight percent of 2 mercapto-5 octyldithio-1,3,4-thiadiazole, marketed under the Tradename of Amoco 150 by the Amoco Oil Company.
[C]Anti-oxidant = bis(dithiobenzil) iron.
[D]Amoco PCO-059 = detergent/dispersant package marketed commercially by the Amoco Oil Company.
[E]BWL = bearing weight loss.

As can readily be determined from the above Examples, the lubricant additives herein impart extreme pressure, anti-wear friction reducing, copper and lead corrosion inhibition and anti-oxidant properties to lubricant compositions when used in accordance with the disclosure herein. In particular, it is noted that the lubricating composition prepared in accordance with the invention, i.e., Example XX, provided especially useful results. Obviously, many modifications and variations of the invention, as hereinbefore set forth, may be made without departing from the spirit and scope thereof, and therefore only such limitations should be imposed as are indicated in the appended claims.

We claim:

1. A lubricating composition comprising a major amount of a lubricating oil and a minor amount of:

(A) An extreme pressure, anti-wear and friction reducing boron compound of the formula:

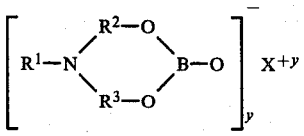

wherein $R^1$ is hydrogen, alkyl, cyclic, alicyclic, aryl, alkylaryl, or arylalkyl radicals having from 1 to about 24 carbon atoms, $R^2$ and $R^3$ are the same or different, straight or branched carbon chains, cyclic, alicyclic, aryl, alkylaryl or arylalkyl radicals having from 2 to about 20 carbon atoms, y is a number from 1 to 4, and X is either hydrogen, a transition metal having an atomic number between 21 and 30 or a Group IVA metal of the Periodic Table and mixtures thereof;

(B) A copper corrosion inhibitor comprising a hydrocarbon polysulfide derivative of 2,5-dimercapto-1,3,4-thiadiazole having the formula

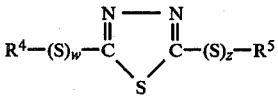

wherein $R^4$ and $R^5$ are moieties selected from hydrogen or straight or branched chain alkyl, cyclic, alicyclic, aryl, alkylaryl or arylalkyl radicals having from 2 to about 30 carbon atoms, provided that $R^4$ and $R^5$ are not both hydrogen and w and z are numbers from 1 to about 8;

(C) a lead corrosion inhibitor comprising terephthalic acid; and (D) an anti-oxidant comprising a bis(dithiobenzil) metal derivative having the formula:

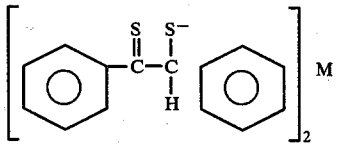

wherein M is a first row transition metal having an oxidation state of +2.

2. The lubricating composition defined in claim 1 wherein the extreme pressure, anti-wear and friction reducing boron compound comprises from about 0.1 to about 15 weight percent of said composition.

3. The lubricating composition defined in claim 1 wherein $R^1$ of the boron compound is hydrogen, alkyl, cyclic, alicyclic, aryl, alkylaryl, or aryl alkyl having from 1 to about 18 carbon atoms.

4. The lubricating composition defined in claim 1 wherein $R^2$ and $R^3$ of the boron compound are straight or branched carbon chains, alkyl, cyclic, alicyclic, aryl, alkylaryl or arylalkyl radicals having from about 2 to about 10 carbon atoms.

5. The lubricating composition defined in claim 1 wherein X of the boron compound is scandium, titanium, vanadium, chromium, manganese, iron, cobalt, nickel, copper, zinc, tin or lead or a mixture thereof.

6. The lubricating composition defined in claim 1 wherein the extreme pressure, anti-wear and friction reducing boron compound is methylaminodiethylate hydrogen borate, ethylaminodiethylate hydrogen borate, propylaminodiethylate hydrogen borate, butylaminodiethylate hydrogen borate, octadecylaminodiethylate hydrogen borate, dodecylaminodiethylate hydrogen borate, cyclohexylaminodiethylate hydrogen borate, phenylaminodiethylate hydrogen borate, oleylaminodiethylate hydrogen borate, cocoaminodiethylate hydrogen borate, tallowaminodiethylate hydrogen borate or dodecylamino di(phenylethylate) hydrogen borate or a mixture thereof.

7. The lubricating composition defined in claim 6 including a metal derivative of the boron compound wherein the metal is scandium, titantium, vanadium, chromium, manganese, iron, cobalt, nickel, copper, zinc, tin or a mixture thereof.

8. The lubricating composition defined in claim 1 wherein boron comprises from about 0.5 to about 10 weight percent of said boron compound.

9. The lubricating composition defined in claim 1 wherein a transition metal or a Group IVA metal comprises from about 1 to about 17 weight percent of said boron compound.

10. The lubricating composition defined in claim 1 wherein $R^4$ and $R^5$ of the copper corrosion inhibitor are straight or branched chain alkyl, cyclic, alicyclic, aryl, alkylaryl or arylalkyl radicals having from 4 to about 16 carbon atoms and w and z are numbers from 1 to about 4.

11. The lubricating composition defined in claim 1 wherein the copper corrosion inhibitor comprises from 0.001 to about 5 weight percent of said composition.

12. The lubricating composition defined in claim 1 wherein the copper corrosion inhibitor is 1,3,4-thiadiazole-2,5-bis (octyldisulfide); 1,3,4-thiadiazole-2,5 bis(octyltrisulfide); 1,3,4-thiadiazole-2,5 bis (octyltetrasulfide); 1,3,4-thiadiazole-2,5 bis (dodecyldisulfide); 1,3,4-thiadiazole-2,5 bis (dodecyltrisulfide); 1,3,4-thiadiazole -2,5 bis dodecyltetrasulfide; 2-lauryldithia-5-thiaalpha-methylstyryl-1,3,4 thiadiazole; 2-lauryltrithia-5-thiaalpha-methylstyryl-1,3,4 thiadiazole; 2 mercapto-5 octyldithio-1,3,4-thiadiazole or 2 mercapto-5 dodecyldithio-1,3,4-thiadiazole or a mixture thereof.

13. The lubricating composition defined in claim 1 comprising from 0.001 to about 1 weight percent of terephthalic acid as a lead corrosion inhibitor.

14. The lubricating composition defined in claim 1 wherein the anti-oxidant comprises from 0.01 to about 1 weight percent of said composition.

15. The lubricating composition defined in claim 1 wherein m of the anti-oxidant is iron, cobalt, nickel, copper, zinc, vanadium, chromium or manganese or a mixture thereof.

16. The lubricating composition defined in claim 1 wherein the anti-oxidant is bis(dithiobenzil) iron, bis(dithiobenzil) cobalt, bis(dithiobenzil) nickel, bis(dithiobenzil) copper, bis(dithiobenzil) zinc, bis(dithiobenzil) vanadium, bis(dithiobenzil) chromium or bis(dithiobenzil) manganese or a mixture thereof.

17. A lubricating composition comprising a major amount of a lubricating oil and a minor amount of:

(A) An extreme pressure, anti-wear and friction reducing boron compound selected from methylaminodiethylate hydrogen borate, ethylaminodiethylate hydrogen borate, propylaminodiethylate hydrogen borate, butylaminodiethylate hydrogen borate, octadecylaminodiethylate hydrogen borate, dodecylaminodiethylate hydrogen borate, cyclohexylaminodiethylate hydrogen borate, phenylaminodiethylate hydrogen borate, oleylaminodiethylate hydrogen borate, cocoaminodiethylate hydrogen borate, tallowaminodiethylate hydrogen borate, or dodecylamino di(phenyl ethylate) hydrogen borate or a mixture thereof;

(B) A copper corrosion inhibitor comprising a hydrocarbon polysulfide derivative of 2,5-dimercapto-1,3,4-thiadiazole selected from 1,3,4-thiadiazole-2,5-bis (octyldisulfide); 1,3,4-thiadiazole-2,5 bis(octytrisulfide); 1,3,4-thiadiazole-2,5 bis (dodecyldisulfide); 1,3,4-thiadiazole-2,5 bis (dodecyltrisulfide); 1,3,4-thiadiazole -2,5 bis (dodecyltetrasulfide; 2-lauryldithia-5-thiaalpha-methylstyryl-1,3,4 thiadiazole; or 2-lauryltrithia-5-thiaalpha-methylstyryl-1,3,4 thiadiazole; 2 mercapto, 5-octyldithio-1,3,4-thiadiazole or 2 mercapto, 5-dodecyldithio-1,3,4-thiadiazole or a mixture thereof.

(C) A lead corrosion inhibitor comprising terephthalic acid; and (D) an anti-oxidant comprising a bis(dithiobenzil), metal derivative selected from the group consisting of bis(dithiobenzil) iron, bis(dithiobenzil) cobalt, bis (dithiobenzil) nickel, bis(dithiobenzil) copper and bis (dithiobenzil) zinc and mixtures thereof.

18. The lubricating composition defined in claim 17 wherein the boron compound includes a transition metal having an atomic number of from 21 to 30 or a Group IVA metal.

19. The lubricating composition defined in claim 18 wherein the transition metal or Group IVA metal is scandium, titanium, vanadium, chrominum, manganese, iron, cobalt, nickel, copper, zinc, tin or lead or a mixture thereof.

20. The lubricating composition defined in claim 18 wherein the transition metal or Group IVA metal comprises from about 5 to about 10 weight percent of said compound.

21. The lubricating composition defined in claim 17 wherein the boron compound comprises from about 0.5 to about 10 weight percent of said composition.

22. The lubricating composition defined in claim 17 wherein the copper corrosion inhibitor comprises from about 0.005 to about 2.5 weight percent of said composition.

23. The lubricating composition defined in claim 17 wherein the lead corrosion inhibitor comprises from about 0.01 to about 0.05 weight percent of said composition.

24. The lubricating composition defined in claim 17 wherein the anti-oxidant comprises from about 0.025 to about 0.10 weight percent of said composition.

25. A lubricating composition comprising a major amount of a lubricating oil and a minor amount of:

(A) from about 0.5 to about 10 weight percent of an extreme pressure, anti-wear and friction reducing boron compound selected from methylaminodiethylate hydrogen borate, phenylaminodiethylate hydrogen borate, octadecylaminodiethylate hydrogen borate, cocoaminodiethylate hydrogen borate, tallowaminodiethylate hydrogen borate, a dodecylamino di(phenylethylate) hydrogen borate or a mixture thereof;

(B) from about 0.005 to about 2.5 weight percent of a copper corrosion inhibitor selected from 1,3,4-thiadiazole-2,5-bis (octydisulfide); 1,3,4-thiadiazole-2,5 bis(octy-trisulfide); 1,3,4-thiadiazol-2,5 bis (octyltetrasulfide); 1,3,4-thiadiazole-2,5 bis (dodecyldisulfide); 1,3,4-thiadiazole-2,5 bis (dodecyltrisulfide); 2 mercapto, 5-octyldithio-1,3,4-thiadiazole or 2 mercapto, 5-dodecyldithio-1,3,4-thiadiazole or a mixture thereof.

(C) from about 0.01 to about 0.05 weight percent of a lead corrosion inhibitor comprising terephthalic acid; and (D) from about 0.025 to about 0.10 weight percent of an anti-oxidant selected from the group consisting of bis(dithiobenzil) iron, bis(dithiobenzil) cobalt and bis(dithiobenzil) nickel and mixtures thereof.

26. The lubricating composition defined in claim 25 wherein the boron compound includes from about 5 to about 10 weight percent of a metal selected from the group consisting of nickel, zinc, copper and lead and mixtures thereof.

27. A lubricating composition comprising a major amount of a lubricating oil and from about 0.5 to about 10 weight percent of cocoaminodiethylate hydrogen borate, from about 0.005 to about 2.5 weight percent of a copper corrosion inhibitor selected from the group consisting of 1,3,4-thiadiazole-2,5- bis(octyldisulfide)

and 2 mercapto, 5-octyldithio- 1,3,4-thiadiazole and mixtures thereof, from about 0.001 to abut 1 weight percent of terephthalic acid; and from about 0.025 to about 0.10 weight percent of bis(dithiobenzil) iron.

28. The lubricating composition defined in claim 27 wherein the cocoaminodiethylate hydrogen borate includes from about 5 to about 10 weight percent of a metal selected from the group consisting of nickel, zinc, copper and lead mixtures thereof.

29. A lubricating composition comprising a major amount of a lubricating oil and from about 0.5 to about 10 weight percent of dodecylamino di(phenyl ethylate) hydrogen borate, from about 0.005 to about 2.5 weight percent of copper corrosion inhibitor selected from the group consisting of 1,3,4-thiadiazole- 2,5-bis (octyldisulfide) and 2 mercapto, 5-octyldithio- 1,3,4-thiadiazole and mixtures thereof, from about 0.001 to about 1 weight percent of terephthalic acid, and from about 0.025 to about 0.10 weight percent of bis(dithiobenzil) nickel.

30. The lubricating composition defined in claim 29 wherein the dodecylamino di(phenyl ethylate) hydrogen borate includes from about 5 to about 10 weight percent of a metal selected from the group consisting of nickel, zinc, copper and lead and mixtures thereof.

31. A lubricating composition comprising a major amount of a lubricating oil and a minor amount of:

(A) An extreme pressure, anti-wear and friction reducing boron compound of the formula:

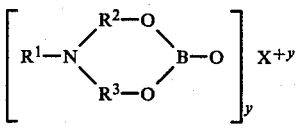

wherein $R^1$ is hydrogen, alkyl, cyclic, alicyclic, aryl, alkylaryl, or arylalkyl radicals having from 1 to about 24 carbon atoms, $R^2$ and $R^3$ are the same or different, straight or branched carbon chains, cyclic, or alicyclic radicals having from 2 to about 20 carbon atoms, y is a number from 1 to 4, and X is either hydrogen, a transition metal having an atomic number between 21 and 30 or a Group IVA metal of the Periodic Table and mixtures thereof;

(B) a copper corrosion inhibitor comprising a hydrocarbon polysulfide derivative of 2, 5-dimercapto-1,3,4-thiadiazole having the formula:

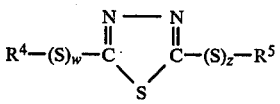

wherein $R^4$ and $R^5$ are moieties selected from hydrogen or straight or branched chain alkyl, cyclic, alicyclic, aryl, alkylaryl or arylalkyl radicals having from 2 to about 30 carbon atoms, provided that $R^4$ and $R^5$ are not both hydrogen and w and z are numbers from 1 to about 8:

(C) a lead corrosion inhibitor comprising terephthalic acid; and (D) an anti-oxidant comprising a bis(dithiobenzil) metal derivative having the formula:

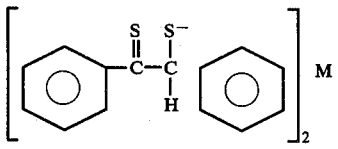

wherein M is a first row transition metal having an oxidation state of +2.

32. The lubricating composition defined in claim 31 wherein the extreme pressure, anti-wear and friction reducing boron compound comprises from about 0.1 to about 15 weight percent of said composition.

33. The lubricating composition defined in claim 31 wherein $R^1$ of the boron compound is hydrogen, alkyl, cyclic, alicyclic, aryl, alkylaryl, or aryl alkyl having from 1 to about 18 carbon atoms.

34. The lubricating composition defined in claim 31 wherein $R^2$ and $R^3$ of the boron compound are straight or branched carbon chains, alkyl, cyclic, or alicyclic radicals having from about 2 to about 10 carbon atoms.

35. The lubricating composition defined in claim 31 wherein X of the boron compound is scandium, titanium, vanadium, chromium, manganese, iron, cobalt, nickel, copper, zinc, tin or lead or a mixture thereof.

36. The lubricating composition defined in claim 31 wherein $R^2$ and $R^3$ of the boron compound are straight or branched carbon chains having from about 2 to about 20 carbon atoms.

37. The lubricating composition defined in claim 31 wherein $R^2$ and $R^3$ are alkyl having from about 2 to about 20 carbon atoms.

* * * * *